US005108514A

United States Patent [19]

Kisner

[11] Patent Number: 5,108,514

[45] Date of Patent: Apr. 28, 1992

[54] IN-SITU METHOD FOR CLEANING SWIMMING POOLS WITHOUT DRAINING THE WATER

[76] Inventor: Kim T. Kisner, 2125 E. Balboa Dr., Tempe, Ariz. 85282

[21] Appl. No.: 652,565

[22] Filed: Feb. 8, 1991

[51] Int. Cl.[5] ..... B08B 3/08; B08B 3/14; B08B 5/04; B08B 9/00

[52] U.S. Cl. ..... 134/22.1; 134/21; 134/27; 134/28; 134/29; 134/41; 134/42; 210/696; 210/697; 210/699; 210/698; 210/700; 210/743

[58] Field of Search ..... 134/21, 22.1, 27, 28, 134/29, 3, 41, 42; 210/696, 697, 699, 698, 700, 743

[56] References Cited

U.S. PATENT DOCUMENTS

| | | | |
|---|---|---|---|
| 3,080,590 | 3/1963 | Mullinix et al. | 134/41 |
| 4,009,049 | 2/1977 | Pansini | 134/21 |
| 4,906,384 | 3/1990 | Hamilton | 134/27 |
| 5,018,890 | 5/1991 | May | 134/3 |

*Primary Examiner*—Theodore Morris
*Assistant Examiner*—Zeinab El-Arini
*Attorney, Agent, or Firm*—Charles P. Padgett, Jr.

[57] ABSTRACT

This invention discloses an in-situ process or method for cleaning the interior surfaces of a swimming pool or the like for removing stains, scale, calcium deposits, and the like, and without the need for draining the pool. The chlorine content of the pool is initially tested, and chlorine is added to bring it up to a level sufficient to prevent algae growth for a period of up to 10 days without filtering. Water is added to the pool to insure all water line marks are sufficiently immersed so as to benefit from the cleaning operation. An acid wash solution, including a mixture of hydrochloric acid and a strong metal chelating agent, is then applied in-situ or as close to the surfaces to be cleaned as possible. As the stains, scale, and deposits dissolve, a strong organic acid such as oxalic acid is added to precipitate out the undesirable materials and cause them to settle down to the bottom of the pool for subsequent vacumming. The pool is then vacuumed and backwashed to totally remove the precipitates from the system, and the pH is then raised by adding sodium carbonate. Finally, a strong metal chelating agent is added to stabilize the pH in a desirable range of from 7.2–7.6 and to prevent redeposits from forming after the cleaning operation is complete.

33 Claims, 2 Drawing Sheets

IN-SITU METHOD FOR CLEANING SWIMMING POOLS WITHOUT DRAINING THE WATER

BACKGROUND OF THE INVENTION

1. Field Of The Invention

The present invention relates to a method for cleaning the interior surfaces of a water-containing vessel, and more particularly to a method for removing stains, scale, calcium deposits and the like from the walls and bottom of a swimming pool or the like, in-situ, and without the need for draining the water from the pool.

2. Brief Description Of The Prior Art

There are no known prior art patents even remotely related to the method of the present invention. However, the closest known patent in U.S. Pat. No. 4,906,384, which issued on Mar. 20, 1989 to Jock Hamilton for a NO DRAIN ACID TREATMENT OF POOLS. This patent teaches a method for treating the water within a swimming pool for removing scale deposits from the interior surfaces of the pool containing the water. The patent specifically teaches acidifying the pool water a mixture of hydrochloric acid, sulfamic acid, and sodium bisulfate to eliminate its total alkalinity. The water must be continually monitored throughout the entire process for total alkalinity. After the acid treatment, all excess treatment acid is neutralized by magnesium oxide or magnesium hydroxide as the normal alkalinity of the pool is restored.

This method requires a large quantity of chemicals since all of the water in the pool is treated simultaneously. The need for continual monitoring or testing is very time consuming and critical to the process. Thus, it may prove quite difficult when the process is to be used by ordinary pool owners.

Furthermore, since the stain and scale-causing chemicals remain in solution in the swimming pool, and in spite of the inventor's allegation that scales will not reform immediately thereafter, they will reform rather quickly over a short period of time. Still further, since all of the pool water is treated, the treatment process takes a relatively long time to complete.

Since the acid solution is added to the pool water in general, it is relatively dilute, thus taking a long time to work. Also, the chemicals used will cause real damage to the pool circulation system since the inventor does not disable the system during the treatment process. Since he does not adjust the chlorine level initially, excessive algae growth will present another very real problem. Further yet, the by-products of his chemicals are very, very difficult to remove from the system when they are left in the pool since they quickly combine with clay particles, silica, and the like to form scale deposits on the interior pool surfaces which are even more difficult to remove than the original calcium deposits.

These and other problems of this prior art method and others of the prior art are solved without producing any new problems, by the method of the present invention as hereinafter described.

BRIEF SUMMARY OF THE INVENTION

It is an object of the present invention to provide an improved method system or procedure for cleaning the interior surfaces of a water-containing vessel, such as a swimming pool, to remove stains, scale, calcium deposits, and the like without the need for draining the water from the vessel.

It is another object of this invention to provide such a method wherein the process is done in-situ and thus does not require treatment of all of the water in the pool.

It is a further object of the present invention to provide such a method which is relatively fast.

It is still another object of the present invention to provided such a method wherein the acid wash solution applied to the interior surfaces is relatively more concentrated than those previously used.

It is a further object of the present invention to provide such a method which is not troubled by excessive algae growth.

It is still a further object of the present invention to provide such a method which does not require continuous monitoring or testing.

It is yet another object of the present invention to provide such a method which requires far less chemicals than do those of the prior art.

It is a further object of this invention to provide such a method in which only the in-situ water is brought to zero alkalinity.

It is still a further object of this invention to provide such a method wherein substantially all calcium hardness and other precipitates are physically removed permanently from the water via conventional vacuuming and backwashing techniques.

It is yet a further object of the present method to provide such a method wherein substantially no harmful by-products are produced.

It is object of the present invention to provide a method wherein there is substantially no re-scaling once the cleaning process is completed.

It is another object of the present invention to provide such a method wherein damage or etching to the interior pool surfaces is prevented.

It is still another object of this invention to provide such a method which can be used with plaster, vinyl, fiberglass, painted concrete, or painted plaster pools without any harmful effects.

It is yet another object of this invention to provide such a method which results in a safe, extremely effective, relatively simple process for removing stains and scales from swimming pools without the need for draining the pool water.

It is a further object of this invention to provide such a method which can be quickly and easily used to remove stains and scale deposits from the interior walls and bottom of swimming pools by ordinary pool owners.

It is an object of the present invention to provide a method which actually takes the water hardness and scale deposit-causing materials out of the pool water instead of dissolving or suspending same in the pool water for subsequent redeposit.

It is another object of this invention to provide such a method which uses an acid wash solution including a mixture of concentrated hydrochloric acid and a relatively strong metal chelating agent such as ethylene diamine tetraacidic acid (EDTA), for scale removal purposes.

The present invention teaches a method of removing stains, scale, calcium deposits, and the like from the interior surfaces of a water-containing vessel, such as from the interior walls and bottom of a swimming pool or the like, without the need for draining the water from the vessel before, during, or after the cleaning operation. The process includes the step of applying, in-situ, an acid wash solution which includes the combination of a relatively concentrated acid which does not produce metal ions, such as hydrochloric acid, and a relatively strong metal chelating agent, such as EDTA and/or its derivatives, as directly as possible to the interior surfaces of the vessel to be cleaned.

The application is "in-situ" in that only the water in a zone proximate the surfaces to be cleaned is actually treated with the bulk of the remaining major volume or bulk of the pool water not being treated. The process then includes adding a relatively strong organic acid to precipitate out any water soluble compounds and then removing the precipitates from the water of the vessel by conventional vacuuming and backwashing techniques. The process then contemplates adding at least one hydroxide or carbonate compound, such as sodium carbonate, to raise the pH and alkalinity of the water to prevent equipment corrosion, and then adding a chelating agent to prevent the calcium and metal ions remaining or later introduced from redepositing on the interior surfaces after the cleaning operation is completed.

The step of applying contemplates the step of pouring the acid wash solution into the vessel by pouring it in close proximity to the interior walls and bottom of the pool. Alternately, an applicator may be used to apply the acid wash solution directly to the surfaces to be cleaned via a pumping arrangement or a pressurized tank, in which the later is used for large municipal, commerical, or institutional pools. One very important aspect of the application method is that the entire water system is not treated, but only the zone or in-situ portion directly adjacent the surfaces to be cleaned.

The process also contemplates measuring the initial chlorine level in the pool and bringing the chlorine level up to a predetermine desired range in order to prevent the formation of trouble-causing algae and the like. Furthermore, the pump system of the pool is turned off during the early cleaning stages and is not turned on again until it is required for vacuuming purposes. This prevents damage to the pump and related systems from the relatively concentrated acids being used. Once the acid wash solution is applied to the interior surfaces to be cleaned, it is allowed to sit for a relatively short time, and then light scrubbing and/or brushing may be used to remove the stains, scales, and deposits from the walls.

These and other objects and advantages of the present invention will be more fully understood after reading the Detailed Description Of The Preferred Embodiment Of The Present Invention, the Claims, and the Drawings, which are briefly described hereinbelow.

DETAILED DESCRIPTION OF THE INVENTION

Figure 1:
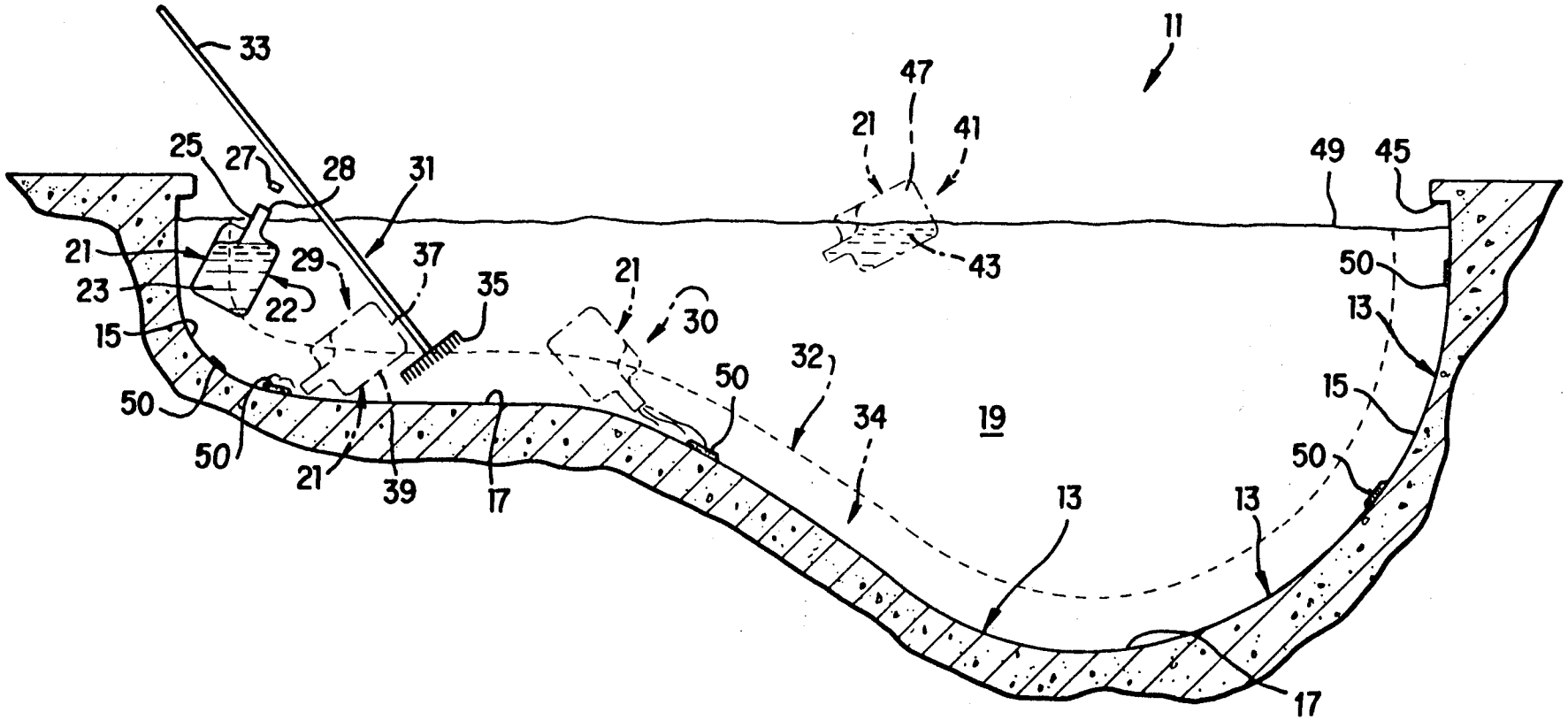
FIG. 1 is a sectional side view of a swimming pool wherein a first method of applying, in-situ, the acid wash solution of the present invention is illustrated.

The present invention provides a system, method, or process for cleaning the interior surfaces of any relatively large water-containing vessel whose interior surfaces are marred by stains, scale, calcium deposits or other undesirable deposits, and the like. Preferably, the present invention is meant to be used with recreation water-containing units such as swimming pools, spas and the like. These swimming pools may be of substantially any size ranging from relatively large municipal, commercial, or institutional swimming pools to intermediate size swimming pools such as those often found in hotels, motels, apartment complexes, and the like and on to smaller swimming pools such as those normally associated with single family dwellings.

The present invention is designed to be used or accomplished by an ordinary pool owner without the need for a professional pool cleaning service. Substantially all of the work can be done at the actual swimming pool location or site using readily available materials plus the chemicals which are normally supplied in a kit form.

First of all, either the pool owner or the kit seller must prepare an acid wash solution comprising water and a mixture of a relatively concentrated acid which does not produce metal ions in a water solution and a relatively strong metal chelating agent. The relatively strong or concentrated acid may be any one or more of hydrochloric acid, nitric acid, acetic acid, oxalic acid, or the like. In the preferred embodiment of the present invention, the mixture of the acid wash solution will contain hydrochloric acid. Similarly, the preferred embodiment of the strong metal chelating agent includes ethylene diamine tetraacidic acid, known in the art as EDTA and/or its derivatives. Preferably, the acid wash solution includes 20–31.5% by weight of the hydrochloric acid and approximately 3–10% by weight of the EDTA.

Initially, in order to avoid complications from excessive algae growth during the acid wash process, during which process the pumping system will be shut dowm and therefore the water will be stagnated for a relatively long period of time, the chlorine level of the water in the pool is adjusted. A conventional test, well known in the art, is first run to measure the existing chlorine level in the pool before the treatment process is begun. If the chlorine level is below 1 ppm, chlorine is added. The chlorine is preferably added to the water in the pool in the granular form of Trichloro-Triazinetrione until the chlorine level is brought up to a predetermined desirable range of from 2 ppm to 5 ppm. However, liquid chlorine may be also used if time is a factor. Once the proper chlorine level has been attained, thereby eliminating the possibility of any problem of excessive algae growth, all of the pump system of the pool are turned off. Water is then added to the pool to raise the pool's water level above the normal level to insure any water mark resulting from the normal water line will be sufficiently immersed to benefit from the acid wash cleaning step.

The method of the present invention then requires applying, in-situ, the acid wash solution as directly as possible to the interior surfaces of the vessel to be cleaned, i.e. to the walls and bottom of the swimming pool. This application step may include any of several variables or variations.

Since the acid wash solution is to be applied in-situ, only the zone or volume of water immediately adjacent and a predetermined distance from the internal surfaces of the pool which need to be cleaned will be treated or reduced to zero alkalinity. Therefore, the great bulk or mass of the water remaining in the pool will not be treated. This has several advantages including the advantage that the acid wash solution is far more concentrated as it reaches the area to be cleaned, therefore far less chemicals need to be used, and consequently the process is far faster and far less costly or expensive than any known process which attempts to treat all of the water in the pool.

The present method of in-situ application may be accomplished by pouring the acid wash solution into the swimming pool such that it is poured in close proximity to the inerior walls and bottom of the pool. Similarly stated, it is applied as directly as possible and as close as possible to the interior surfaces of the vessel or pool which require cleaning. In the present invention, any suitable method of application which accomplishes this purpose and results in an in-situ application of the acid wash solution to the walls and bottom of the pool may be used. Three methods are descrcbed herein with respect to FIGS. 1,2, & 3, as hereinafter described.

One method of in-situ cleaning is illustrated in FIG. 1. In FIG. 1, a swimming pool 11 is shown as having interior surfaces 13 comprising both the side or wall surfaces 15 and the lower or bottom surfaces 17. The pool 11 includes a quantity of water 19 having an upper surface 49 which falls just short of a swimming pool lip or rim 45. A container 21, such as conventional one-gallon plastic jug or bottle, is filled with the acid wash solution 23, and as it is lowered into the pool 11 and immediately adjacent to the side 15, the cap 27 is removed from the neck 25 to expose the open mouth 28. The container 21 is shown in solid lines in the first position as is indicated by reference arrow 22. In practice, the neck 25 is then tipped or tilted toward the wall surfaces 15 once the cap 27 is removed, and bottle 21 is allowed to sink down the side 15 towards the bottom surface 17. Since the acid wash solution 23 within the bottle 21 is heavier than the water 19, the acid wash solution 23 will spill from the bottle substantially directly onto the interior surface or side 15. As it slides along the wall surface 15 towards the bottom surface 17, the acid wash solution 23 pours out of the opening 28 directly onto the side or wall surfaces 15 and over the deposits 50 which are to be removed. The dotted line 32 shows the approximate boundary of the in-situ area or zone immediately adjacent the wall 15 and bottom 17 surfaces within which zero alkalinity is to be obtained. The area exterior of the dotted line 32, containing the bulk or far greater quantity or volume of the pool water 19 is not treated to any substantial extent during the process or method of the present invention.

As the bottle 21 slides further down the wall 15 towards the bottom 17, an instrument such as a brush apparatus 31 may be used to insure that the acid wash solution is spilled toward the wall surface 15 or bottom surface 17. The brush apparatus 31 includes a conventional elongated handle portion 33 and a brush portion 35 which is preferably of a wire construction. The handle or pole 33 can be brought into contact with the bottom 37 of the bottle 21 and/or the brush portion 35 can be brought into contact with a side portion 39 of the bottle 21 to adjustably position the bottle 21 to insure that the acid wash solution spilling or pouring therefrom spills directly onto the interior surfaces of the walls 15 or bottom 17, as previously described, for in-situ treatment. Furthermore, the handle section 33 and brush portion 35 can be positioned to hold or clamp the bottle 21 against the wall surface 15 at a point materially above the bottom surface 17 thereby insuring that the substantially vertical wall 15 receives an adequate exposure to the flowing acid wash solution 23.

A second or downstream position of the bottle 21 is illustrated by reference numeral 29. In this position, the bottle 21 is shown as being tilted such that the neck 25 and open mouth 28 are disposed immediately adjacent the surfaces 15 and 17 onto the stains, scales, calcium deposits, and the like, as represented by reference numeral 50. Still further, reference numeral 30 illustrates the bottle 21 in a third position wherein the neck is still tilted toward the bottom surface 17 to continue to insure that the acid wash solution is spilled directly on the deposits 50 as previously described. The bottle 21 will continue to slide downwardly along the bottom 17 until substantially all of the acid wash solution has emptied therefrom. At this point, carbon dioxide resulted from the reaction of hydrochloric acid and scale deposits collects in the bottle 21 and thereby enables it to rise to the surface 49 as illustrated in position 41 which shows that the bottle 21 is partially full of liquids, substantially all pool water 43, and air 47 sufficient to cause the bottle to float on the surface. The bottle then can be retrieved, refilled and reused by reinserting it into the pool adjacent another side thereof, and this process is continued along all sides of the pool until substantially all interior wall and bottom surfaces to be cleaned have had the acid wash solution applied thereto, and until substantially all interior surface portions of the bottom 17 have similarly had the acid wash solution applied substantially directly thereto.

Figure 2:
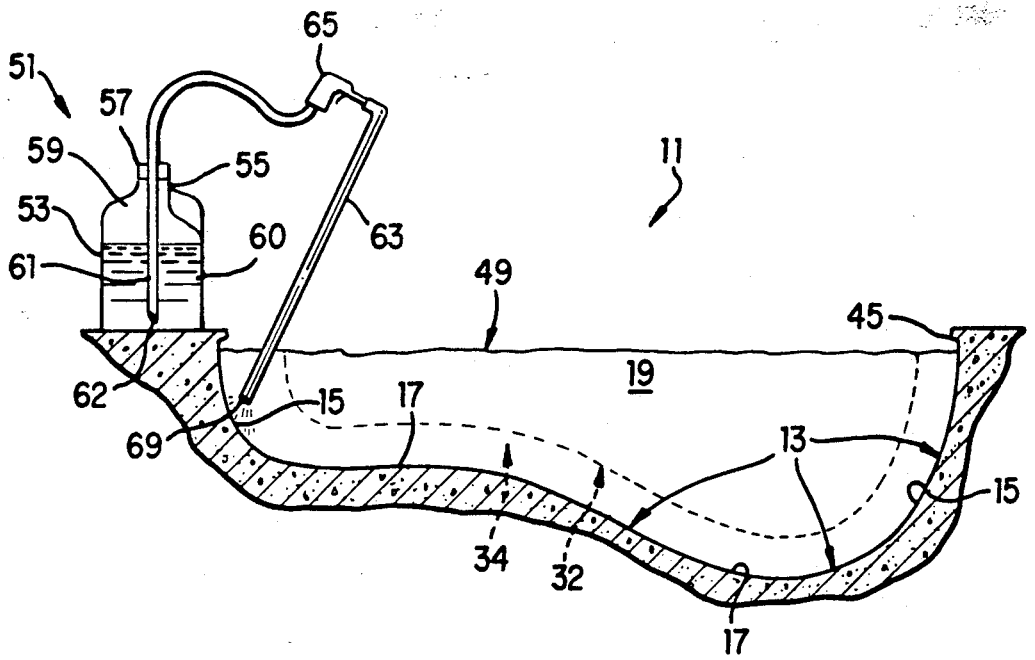
FIG. 2 is a similar view wherein an alternate, in-situ, application method is illustrated.

FIG. 2 shows an alternate application method which utilizes a spray gun assembly 51 including a container 53, typically a conventional one-gallon plastic jug, having a neck portion 55 and a stopper 57 having an aperture therethrough. The interior of the bottle 53 includes a portion of acid wash solution 60 and a portion of air 59. A generally flexible tube or hose 61 is inserted through the aperture of the stopper 57 and through the mouth 55 of the bottle 53 until its open lower end 62 is disposed adjacent the bottom of the bottle well under the level of the acid wash solution 60. The opposite open end of the flexible tube 61 is attached to a fairly rigid tube or hose 63, via a spray gun 65, which is capable of drawing the acid wash solution in bottle 53 up through hose 61 by a pumping means. The opposite or lower end of the applicator tube 63 has a dispensing opening or application aperture 69 therein. The pumping principle is used to draw the acid wash solution 60 from the bottle 53 up through the tube 61, the spray gun 65, and down through the applicator tube 63 until it flows out of the opening 69 to flood or bath the interior surfaces 15 and 17, as previously described. It will be noted that by using the relatively stiff applicator tube 63, the acid wash solution 60 can be dispensed directly onto interior wall surfaces 15 and bottom surfaces 17 with a much higher degree of accuracy and efficiency than the method of FIG. 1.

Figure 3:
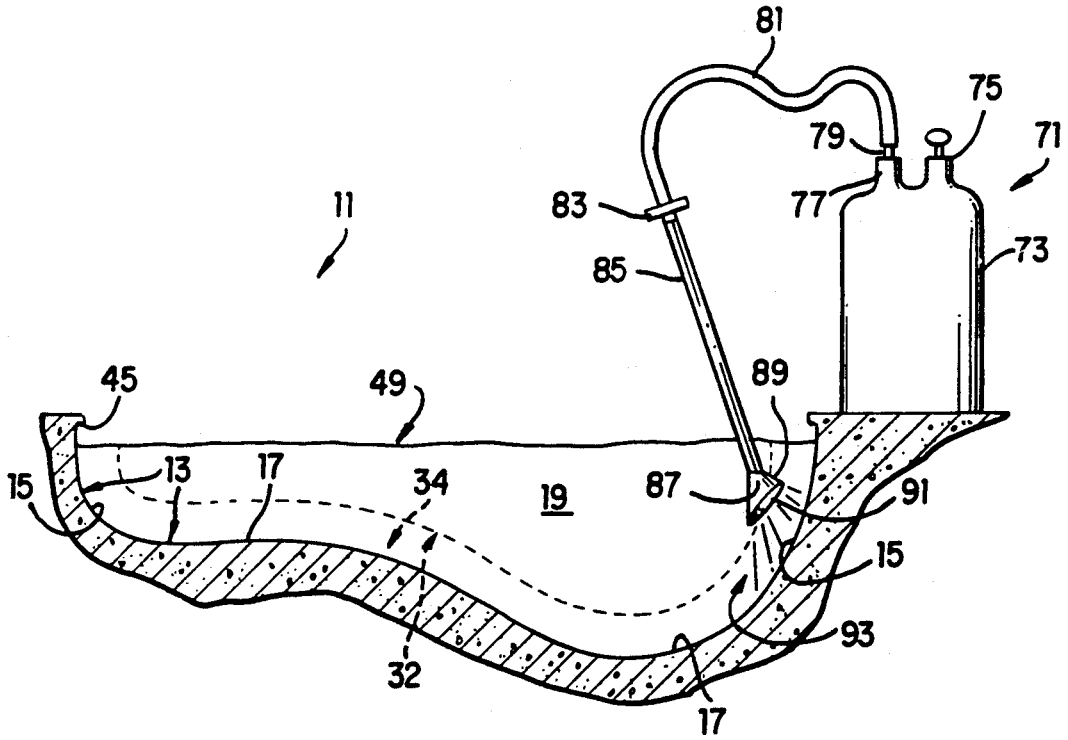
FIG. 3 is yet another view wherein still another alternate, in-situ, application method is shown.

FIG. 3 shows yet another means for applying in-situ the acid wash solution to the interior surfaces of the pool. In FIG. 3, a pressurized tank apparatus 71 which includes a pressurized tank 73 having a pressure regulator or control valve 75 and an output port 77 is used. A needle valve or the like connects the output or outlet 77 to one end of a flexible hose or connector tube 81. The opposite open end of the flexible tube 81 is connected via a hose coupling device 83 to a relatively stiff application wand or tube 85. The open lower end 87 of the relatively rigid application tube 85 is provided with a nozzle apparatus 89 having a larger flared opening 91 which may be used to direct the acid wash solution 93 directly onto the side walls 15 and bottom 17 of the swimming pool 11 as previously described. This system provides an even greater degree of accuracy and efficiency in placing or applying large volumes of the acid wash solution directly to much larger surfaces to be cleaned and greatly insures that the in-situ area of operation is mimimize for economy purposes and the like. This method of applying is used most often for large commercial and institutional pools.

Preferably, the step of applying the acid wash solution to the interior wall and bottom surfaces of the pool is done at a rate of approximately two gallons per 5,000 gallons of pool water. After the application is complete, a predetermined period of time, preferable in the range of two-to-ten minutes, is allowed to elapse before the surface areas needing to be cleaned and brushed and/or scrubbed in a relatively gentle manner. The acid wash solution is allowed to remain in the pool until substantially all of the stains, scale, calcium deposits, and the like are completely removed from the pool surfaces. Simultaneously, the step of brushing or scrubbing lightly is done at least once each day during the waiting period. After the first brushing, the acid wash solution is allowed to sit for approximately 24 hours before another brushing or scrubbing operation is required.

Next, a relatively strong organic acid is added, in-situ, to precipitate out any water soluble compounds. The relatively strong organic acid may include one or more of oxalic acid, citric acid, or acetic acid. In the preferred embodiment of the present invention, a relatively strong oxalic acid is used. The oxalic acid is added at a rate of between 1 lb. and 1.5 lbs. per 4,000 gallons of pool water. The oxalic acid is then left to sit for a predetermined period of time, such as 24 hours. After that period, the pool pump is turned on for initiating the removal step.

The step of removing the precipitates from the water is done by conventional vacumming and backwashing techniques. After the pump is used for vacuuming purposes, the pump is left on for the remainder of the cleaning operation.

Then the step of adding at least one basic compound is used to raise the pH of the pool water. The basic compound may be any one or more of sodium carbonate, sodium hydroxide, potassium hydroxide, magnesium hydroxide, and magnesium oxide, however, in the preferred embodiment of the present invention, sodium carbonate is preferred. The sodium carbonate is added at a rate of approximately of 1 to 1.5 lbs. per 10,000 gallons of pool water.

After the step of adding the sodium carbonate to raise the pH of the pool water, the total alkalinity of the water in the vessel is measured, and we continue to add sodium carbonate at the given rate until the total alkalinity reaches a desired range of between 70 ppm–100 ppm. The measurement are taken every 4 to 6 hours after each addition of the sodium carbonate until this range is attained.

Lastly, the method contemplates the step of adding a chelating agent to prevent calcium and metals from redepositing on the interior surfaces of the pool after the cleaning operation is complete. While the chelating agent can be any ethylene diamine tetracidica compound, in the preferred embodiment, at least one of EDTA, tetrasodium and EDTA, di-ammonium is used. The chelating agent is preferably added at a rate of approximately one pound per 5,000 gallons of pool water and this is repeated until the pH is stabilized in the range of from 7.2 to 7.6.

It will be realized that the prior art systems for cleaning pools wherein the pool water and the acid wash solution is drained, are damaging to the pool surfaces, are damaging to the equipment associated with the pool, and waste a vast amount of water totally, contrary to today's conservation-minded approach to things. Prior art systems are also relatively ineffective and result in a relatively long or lengthy process. Furthermore, if the pool is not drained after cleaning, and the precipitates remain in water solution or otherwise remain in the system, they quickly redeposit often causing stains that are more difficult to remove than were those previously present prior to the cleaning operation. This invention provides a relatively safe, simple, and effective way to remove stains and scale deposits from swimming pools without draining the water. It provides a simple and easy way to remove such stains and scale deposits by a method which can be performed by pool owners as well as by professional service organizations. The present method totally removes the water hardness and scale deposits out of the pool water instead of dissolving or suspending them in the water. This is an important advantage over other pool cleaning methods which leave the hardness and scale deposits in the water because when the pH later becomes greater than 8.0, the scale deposits quickly redeposit back on the pool surfaces. Most of the stains and scale of the calcium deposits react with the acid wash solution to form calcium chloride which is very soluble in low pH water solutions thereby releasing all metal deposits that cause unsightly stains or scale and causing them to precipitate and settle down to the bottom of the pool where they can be removed by conventional vacuuming techniques. At this point the alkalinity of the "in-situ" water in the pool is zero, and the pH is between 6.0 and 6.8. The step of vacuuming up the precipitates and backwashing them out of the filer system insures that the filtered water coming back into the pool is free of matter that could redeposit at a later time.

The process described above teaches that a proper solution of an acid and chelating agent can be incorporated in an in-situ manner to bring only a boundary layer or zone near the pool walls and bottom surfaces to zero alkalinity to accomplish the acid wash. Consequently, for lesser quantities of chemicals can dissolve like stains in less time at lower cost and with no continuous monitoring of alkalinity required. The make-up of the proper solution is an item of the present method. Additionally, the method of the present invention specifically teaches the substantially total removal of the dissolved and precipitated stains, scale and deposits from the pool water.

In practice, the acid wash solution is added in close proximity to the pool's walls and bottom interior surfaces. Since the acid wash solution is substantially denser than water, the acid wash solution sinks along the sides to concentrate on the pool's bottom where the vast majority of stains and scales form. A gentle brushing is performed to accelerate stain removal. The strong organic acid is added to precipitate out dissolved stain-carried materials such as calcium chloride which forms calcium oxalate which is not soluble in water. Sodium carbonate is added in quantities to raise the total alkalinity back to a desired range, and then a chelating compound is added to finalize pH stabilization. It is also important to note that the same EDTA compound remains in the solution to chelate calcium introduced into the pool water through natural processes, thereby further retarding the formation of future scale deposits.

Some of the differences between the method of the present invention and those of the prior art are as follows. First of all, in the present invention, only the in-situ water is brought to zero alkalinity. Secondly, no continuous monitoring is required during the cleaning operation. Thirdly, this requires far less chemicals resulting in substantial cost savings. Still further, the present method is far faster than those of the prior art because the acid remains relatively more concentrated in the areas surrounding the stained pool surfaces due to its higher density, and due to the in-situ application. Still further, substantially all dissolved calcium ions are precipitated out of the water and removed from the pool through vaccuming. Lastly, no harmful by-products are produced which can cause even more difficult to remove stains to form on the pool's surfaces at a later time. The use of sodium carbonate as the preferred neutralizing agent is also important since it is very cost effective, although other neutralizing agents could also be used. The present system is good for and will not harm swimming pools manufactured of plaster, vinyl, fiberglass, and painted plaster.

It will be understood that the main precipitant formed in the present method will be calcium oxalate. The EDTA derivatives will chelate excessive calcium ions in the water thereby preventing subsequent scale deposits from forming. Calcium chloride and calcium bicarbonate will normally precipitate out as calcium oxalate as the major mechanism for removing the stain-causing and scale-causing materials present in the pool water. The calcium oxalate precipitant is quite easily removed by conventional vacuuming and backwashing techniques.

It will be readily seen by those of ordinary skill in the art that various changes, modifications, substitutions, adaptations, variations and the like may be made in the method of the present invention without departing from the spirit and scope thereof which is limited only be the appended claims.

What is claimed is:

1. A method of removing stains, scale and calcium deposits from the interior surfaces of a swimming pool without the need for draining the water from said pool before, during and after the cleaning operation, said method comprising the steps of:

a. applying, in-situ, an acid wash solution which includes the combinatin of a concentrated inorganic acid which does not introduce metal ions into a water solution and a strong metal chelating agent as directly as possible to said interior pool surfaces to be cleaned;

b. later adding a strong organic acid to precipitate out all water soluble compounds;

c. physically removing said precipitates from the pool water by conventional vaccuming and backwashing techniques;

d. subsequently adding to said the interior pool surfaces to be cleaned at least one basic compound to raise the pH and alkalinity of the pool water to the range of 70 ppm to 100 ppm; and e. finally adding to said the interior pool surfaces to be cleaned a metal chelating agent to prevent calcium and other metals from redepositing on the interior pool surfaces after the cleaning operation is completed.

2. The method of claim 1 further including the initial steps of:

a. measuring the initial existing chlorine level in the pool water;

b. adding sufficient chlorine to raise the chlorine level into a desired range of from 2 ppm to 5 ppm;

c. subsequently turning off any pumps associated with said pool; and d. adding water to said pool to raise the pool water level to an above normal level.

3. The method of claim 1 wherein said step of applying in-situ includes the step of applying the acid wash solution into the pool by dispensing same in close proximity to the interior walls and bottom thereof.

4. The method of claim 1 wherein said concentrated acid of said applying step is taken from the group consisting of hydrochloric acid, nitric acid, acetic acid, and citric acid.

5. The method of claim 1 wherein said concentrated acid of said applying step preferably includes hydrochloric acid.

6. The method of claim 5 wherein said strong metal chelating agent includes any of ethylene diamine tetraacidic acid (EDTA) and its derivatives.

7. The method of claim 6 wherein said acid wash solution includes 20% to 31.5% by weight of said hydrochloric acid.

8. The method of claim 7 wherein said acid wash solution includes 3% to 10% by weight of said EDTA and its derivatives.

9. The method of claim 8 wherein said step of applying further includes adding said acid wash solution at a rate of two gallons per 5,000 gallons of vessel water.

10. The method of claim 9 wherein said step of applying further includes the step of pouring said acid wash solution down the interior walls of said pool and over the bottom thereof.

11. The method of claim 10 wherein said step of applying further includes the step of applying said acid wash solution directly on the interior surfaces to be cleaned by means of in-situ applicator means.

12. The method of claim 9 wherein said step of applying further includes the step of waiting for a predetermined period of time before at least one of brushing and scrubbing those surfaces to be cleaned.

13. The method of claim 12 wherein said predetermined period of time is in the range of from 2 to 10 minutes.

14. The method of claim 12 wherein said step of applying still further includes allowing said acid wash solution to remain in said pool until all of said stains, scale and calcium deposits are completely removed while simultaneously continuing to at least one of brush lightly and scrub lightly once each day.

15. The method of claim 9 wherein said step of applying is preceded by the step of deactivating any pump associated with said pool.

16. The method of claim 1 wherein said step of adding a strong organic acid includes adding an acid selected from the group consisting of oxalic acid, citric acid, and acetic acid.

17. The method of claim 1 wherein said strong organic acid preferably includes oxalic acid.

18. The method of claim 17 wherein said oxalic acid is added to said pool at a rate of between 1 and 1.5 pounds per 4,000 gallons of vessel water.

19. The method of claim 1 wherein said basic compound is selected from the group consisting of sodium carbonate, sodium hydroxide, potassium hydroxide, magnesium hydroxide, and magnesium oxide.

20. The method of claim 1 wherein said basic compound preferably includes sodium carbonate.

21. The method of claim 20 wherein said sodium carbonate is added to said pool at a rate of approximately 1 to 1.5 pounds per 10,000 gallons of vessel water.

22. The method of claim 1 wherein said chelating agent of said final adding step includes any ethylene diamine tetraacidic acid compound.

23. The method of claim 22 wherein said chelating agent preferably includes at least one of EDTA, tetrasodium and EDTA, di-ammonium.

24. The method of claim 22 wherein said EDTA compound is added at a rate of one pound per 5,000 gallons of vessel water and repeated until the pH is stabilized in a predetermined desirable range of from 7.2 to 7.6.

25. The method of claim 1 wherein said step of applying includes the steps of:

a. placing a quantity of the acid wash solution in a relatively small container;
b. lowering said container into the pool immediately adjacent to a side thereof which requires cleaning;
c. pouring the acid wash solution from the container;
d. providing a relatively long-handled pole having a brush end attachment;
e. pushing the container on its side along the side and bottom of the pool using said pole and being sure to pass over all surface areas requiring cleaning; and
f. retrieving the empty container as it floats to the surface.

26. The method of claim 1 wherein said step of applying includes the steps of:

a. providing a container having a pumping means and a dispensing nozzle;
b. at least partially filling said container with said acid wash solution;
c. pumping said acid wash solution through said dispensing nozzle; and
d. sliding the nozzle over those interior surfaces of the pool requiring cleaning for applying said acid wash solution directly thereto.

27. The method of claim 1 wherein said step of applying includes the steps of:

a. providing a pressurized tank having a dispensing nozzle;
b. at least partially filling said tank with said acid wash solution;
c. enabling said acid wash solution to flow from the tank to said dispensing nozzle; and
d. sliding the nozzle over those interior surfaces of the pool requiring cleaning for applying said acid wash solution thereto.

28. A method of cleaning a swimming pool to remove stains, scale and calcium deposits from the interior surfaces of the walls and bottom of a swimming pool, in in-situ, and without the need of draining the pool, said method comprising the steps of:

a. measuring the chlorine level in said pool;
b. adding chlorine to the water in said pool until the chlorine level in the pool is within a first predetermined desired concentration range;
c. turning off the pool pump system;
d. adding water to the pool to bring the water in the pool to an above normal level;
e. applying an acid wash solution which includes concentrated hydrochloric acid and a strong ethylene diamine tetra-acetic acid compound (EDTA) as directly as possible to the surfaces to be cleaned;
f. lightly brushing the surfaces to be cleaned a first predetermined period of time thereafter;
g. retaining the acid wash solution in the pool until said stains, scale and calcuim deposits have been completely removed while continuing said light brushing step at least once each day;
h. adding oxalic acid at a predetermined rate to precipitate out undesireable materials;
i. waiting a second predetermined period of time before turning the pool pump system back on to vacuum the bottom of the pool to remove said precipitates;
j. adding sodium carbonate at a predetermined rate until the total alkalinity of the pool is brought into a predetermined concentration range; and
k. adding at least one EDTA chelating compound until the pH of the pool is normalized and no redeposition can occur.

29. A method of removing stains, scale and calcium deposits from the interior surfaces of the walls and bottom of swimming pools and the like, in-situ, and without the need of draining the pool, said method comprising the steps of:

a. measuring the chlorine level of the pool;
b. adding sufficient chlorine to raise the chlorine level to 2 ppm to 5 ppm;
c. turning the pool pump system off;
d. adding water to the pool to raise the water level of the pool to an above normal level;
e. providing an acid wash solution which includes a mixture having 20 to 31.5 weight percent hydrochloric acid and 3 to 10 weight percent of a metal chelating agent such as ethylene diamine tetraacidic acid;
f. applying said acid wash solution at a rate of approximately two gallons per 5,000 gallons of pool water as directly to the pool surfaces as possible and within a predetermined distance from said surfaces without treating the remainder of the water in the pool;
g. brushing down the pool surfaces to which said acid wash solution was applied between two and ten minutes later;
h. allowing said acid wash solution to remain in the pool until substantially all of said stains, scale calcium deposits have been completely removed while continuing to brush the pool walls and bottom lightly approximately once each day;
i. adding oxalic acid at a rate of one pound per 4,000 gallons of pool water and letting same sit for 24 hours;
j. turning the pool pump system back on;
k. vacuuming the precipitates from the bottom of the pool;
l. leaving the pool pump system on;
m. adding sodium carbonate at a rate of 1 to 1.5 pounds per 10,000 gallons of pool water to bring the total alkalinity of the pool to a first range of 70 ppm to 100 ppm;
n. continuing to operate the pool pump for 4 to 6 hours;
o. measuring the total alkalinity of the pool;
p. repeating the steps of adding sodium carbonate, operating the pool pump system, and measuring the total alkalinity of the pool until said first range is reached;

q. measuring the pH of the pool water;

r. adding at least one of EDTA, tetrasodium and EDTA, di-ammonium at a rate of approximately one pound per 5,000 gallons of pool water to raise the pH of the pool water into a second range of 7.2 to 7.6;

s. running the pool pump for approximately 4 to 6 hours;

t. measuring the pH of the pool; and u. repeating the steps of adding said chelating agent, running the pool pump for 4 to 6 hours, and measuring the pH until the pH of the pool water is stabilized within said second range.

30. An in-situ method of removing at least stains, scale and calcium deposits from the interior wall surfaces and the bottom of water containing vessels such as swimming pools without draining the water therefrom, said in-situ method comprising the steps of:

initially measuring the chlorine concentration of the water in said vessel;

adding sufficient chlorine to the water in said vessel to raise the chlorine concentration to a first predetermined desired range;

turning off any pumping system associated with said vessel;

applying, in-situ, an acid wash solution, comprising the combination of at least a concentrated acid which will not introduce metal ions into a water solution and a strong metal chelating agent, to said interior wall surfaces and bottom of said vessel that are to be cleaned without treating the vast bulk of the remaining water in said vessel;

later adding a strong organic acid to precipitate out water soluble compounds once all of said stains, scale and calcium deposits are dissolved by said acid wash solution;

physically and permanently removing said precipitates from the water of said vessel using conventional vacumming and backwashing techniques;

subsequently adding to said interior wall surfaces and bottom of said vessel to be cleaned at least one basic compound to raise the pH and alkalinity of the water in said vessel to the range of 70 ppm to 100 ppm; and finally adding to said interior wall surfaces and bottom of said vessel to be cleaned a metal chelating agent to prevent calcium and other metals from later redepositing on the interior walls and bottom of said vessel once the cleaning operation is completed.

31. The in-situ method of claim 30 wherein said concentrated acid which does not introduce metal ions in a water solution includes hydrochloric acid; wherein said strong metal chelating agent of said acid wash solution includes at least one ethylene diamine tetra-acetic acid compound; wherein said strong organic acid includes at least oxalic acid; wherein said at least one basic compound includes sodium carbonate; wherein said metal chelating agent of said final adding step includes any ethylene diamine tetra-acetic acid compound; and wherein said step of applying said acid wash solution is preceeded by the step of:

pre-mixing said hydrochloric acid and said ethylene diamine tetra-acetic acid compound to produce said acid wash solution.

32. An in-situ method of removing at least stains, scale and calcium deposits from the interior walls and bottom of a water-containing vessel such as a swimming pool without draining the water from said vessel, said in-situ method comprising the steps of:

initially pre-mixing at least a concentrated acid which does not introduce metal ions into a water solution and a strong metal chelating agent to form an acid wash solution;

applying said pre-mixed acid wash solution, in-situ, directly to said interior walls and bottom of said vessel which require cleaning without effecting the great bulk of the remaining water in said vessel;

later adding a strong organic acid to precipitate out undesireable water soluble compounds after said stains, scale and calcium deposits have been dissolved by said acid wash solution;

physically and permanently removing said precipitates from the water in said vessel;

subsequently adding to said interior wall surfaces and bottom of said vessel to be cleaned at least one basic compound to raise the pH and alkalinity of the water in said vessel to a predetermined desired range of 70 ppm to 100 ppm; and finally adding to said interior wall surfaces and bottom of said vessel to be cleaned a metal chelating agent to prevent redeposits on said interior walls and bottom of said vessel once the cleaning operation is completed.

33. The in-situ method of claim 32 wherein said concentrated acid which does not introduce metal ions into a water solution includes hydrochloric acid; wherein said strong metal chelating agent includes any ethylene diamine tetra-acetic acid compound and its derivatives; wherein said at least one basic compound includes sodium carbonate; and wherein said step of applying said acid wash solution is preceeded by the steps of:

measuring the intial chlorine concentration level in the water in the water in said vessel;

adding chlorine to said water in said vessel in a quantity sufficient to raise said chlorine concentration level to a predetermined desired range; and turning off any pumping system associated with said vessel.

* * * * *